US005698943A

United States Patent [19]

Shaffer

[11] Patent Number: 5,698,943

[45] Date of Patent: Dec. 16, 1997

[54] STARTING FLAG FOR USE IN MERCURY DISCHARGE LAMP AND LAMP EMPLOYING SAME

[75] Inventor: John W. Shaffer, Danvers, Mass.

[73] Assignee: Osram Sylvania Inc., Danvers, Mass.

[21] Appl. No.: 661,231

[22] Filed: Mar. 22, 1996

[51] Int. Cl.[6] ..... H01J 61/28

[52] U.S. Cl. ..... 313/565; 313/490; 313/550

[58] Field of Search ..... 313/565, 566, 313/564, 550, 490, 552, 558, 553; 252/181.1, 181.3, 181.4, 181.5, 181.6, 181.7

[56] References Cited

U.S. PATENT DOCUMENTS

| | | | |
|---|---|---|---|
| 3,548,241 | 12/1970 | Rasch et al. | 313/490 X |
| 4,047,071 | 9/1977 | Busch et al. | 313/490 |
| 4,093,889 | 6/1978 | Bloem et al. | 313/229 |
| 4,105,910 | 8/1978 | Evans | 313/490 |
| 4,107,565 | 8/1978 | Isojima et al. | 313/565 |
| 4,157,485 | 6/1979 | Wesselink et al. | 313/174 |
| 4,539,508 | 9/1985 | Mulder et al. | 313/490 X |
| 4,972,118 | 11/1990 | Yorifuji et al. | 313/365 |
| 5,204,584 | 4/1993 | Ikeda et al. | 313/565 |

*Primary Examiner*—Ashok Patel
*Attorney, Agent, or Firm*—Carlo S. Bessone

[57] ABSTRACT

A low pressure mercury discharge lamp includes a sealed envelope defining a discharge space, an electrode disposed at one end of the envelope, mercury vapor sealed in the discharge space, and a starting flag. The starting flag includes a layer of bonded molecular sieve particles adhered to a metal foil.

11 Claims, 1 Drawing Sheet

STARTING FLAG FOR USE IN MERCURY DISCHARGE LAMP AND LAMP EMPLOYING SAME

BACKGROUND OF THE INVENTION

1. Field of the Invention

This invention relates to low-pressure mercury discharge lamps and is directed more particularly to a starting flag for use in such lamps, and to a lamp having such a starting flag.

2. Description of the Prior Art

As illustrated diagrammatically in FIG. 1, prior art low-pressure mercury discharge (fluorescent) lamps 4 intended for use at elevated ambient temperatures often contain an amalgam 1, such as bismuth/indium/mercury, to control the mercury vapor pressure within the lamp 4, and thereby increase the lumen output when the lamp is used under such conditions. The amalgams 1 absorb mercury and reduce the mercury vapor pressure at elevated temperatures, as compared to pure mercury. The mercury vapor pressure controlling amalgam is often located within the lamp base. Depending on the lamp use temperature, and the amalgam composition, lumen output may be increased by 25 percent or more relative to a similar but non-amalgam lamp under the same conditions.

One attending feature of the use of amalgams in fluorescent lamps is that starting becomes more difficult at lower temperatures, such as room temperature. The mercury vapor pressure within the lamp before turn-on may be reduced by the amalgam below levels that permit quick and reliable starting. If the amalgam lamp is to be started under even colder conditions, this problem becomes severe and either the lamp will not start at all or lamp life can be considerably shortened because of a prolonged glow period during each start cycle. This problem has long been recognized and is generally solved by the provision of a starting or auxiliary amalgam 2 that is located so that it can release mercury into the lamp upon heating of the adjacent lamp electrode. The mercury released by the auxiliary amalgam 2, or "starting flag," permits normal lamp starting and operation until the lamp and main amalgam 1 have warmed up to normal operating temperatures. The mercury released by the starting flag 2 is gradually absorbed into the main amalgam 1 during lamp operation so that the main amalgam 1 is the mercury vapor pressure controlling element within the lamp. After turning the lamp off, the starting flag, or auxiliary amalgam 2, cools and gradually absorbs mercury vapor released by the main amalgam 1. It is desirable that the material in the starting flag 2 have an equilibrium mercury vapor pressure lower than that of the main amalgam 1 at any given temperature. As a result of this feature, mercury is gradually transported as vapor from the main amalgam 1 to the starting flag 2 while the lamp 4 is turned off. When the mercury content of the flag 2 reaches a given level, the mercury vapor pressure of the flag is then in equilibrium with that of the main amalgam 1 at that lamp temperature. The starting flag is then ready to again perform its function when the lamp is turned back on.

Referring to FIGS. 1 and 2, it will be seen that a typical starting flag 2, as used in a compact fluorescent lamp 4, includes a piece of expanded stainless steel foil 6 coated with a layer of indium metal 8, and attached to a wire 10 of a mount structure 12, and located at a controlled spacing S, from an associated coil 14. At the time of lamp turn-on, radiant heat from the coil 14 raises the temperature of the starting flag 2 and the indium coating 8 releases much of its quantity of absorbed mercury which helps to promote initiation of the arc discharge within the lamp.

A number of problems attend the standard metal coated starting flag used up to the present time in fluorescent lamps. One has to do with the fact that indium, and many of its alloys, which are the preferred flag coating materials, tend to wet and migrate over adjacent surfaces when they are in the molten phase (as it is during operation of the lamp). Indium can even wet the envelope glass 16 under certain conditions. As a result, the indium tends to migrate onto the lead wire 10 where it no longer operates effectively as a flag to quickly release its mercury content. This is because of the relatively high mass of the lead wire 10 and its consequent slow warm-up rate and low equilibrium temperature as compared to the thin foil substrate 6 of the flag 2. Another problem with the present standard flag is that during lamp processing the indium tend to become oxidized during the heat of lamp sealing. Indium oxide does not perform the mercury absorption and release function that is needed. A third problem has to do with the volatilization of the indium if any arcing to the flag occurs during cathode coating activation, or during lamp life if the flag for any reason becomes excessively hot. Evaporation of indium can result in deposition of indium over the phosphor coating 18 on the inside surface of the envelope 16 and a loss of lumen output and lumen maintenance during lamp life. Yet another problem associated with the indium coated starting flags is that in order to prevent or retard indium migration from the flag 2 onto the lead wire 10, the wire is typically provided with a heavy oxide film, as for example, by heating the wires 10, 20 with a flame during processing. Such oxidation of the lead wires 10, 20 increases contact resistance between the wires 10, 20 and the coil 14, and expands the range of resistance that is presented to the external contacts 22, 24. High resistance lamps do not achieve proper filament temperature for lamp starting on some fluorescent lamp circuits, such as the common "rapid start circuit", which provides a low heating voltage across the coils.

Examples of amalgam fluorescent lamps may be found in U.S. Pat. No. 4,093,889, issued Jun. 6, 1978, to J. Bloem, et al; U.S. Pat. No. 4,105,910, issued Aug. 8, 1978, to G. S. Evans; U.S. Pat. No. 4,157,485, issued Jun. 5, 1979, to G. A. Wesselink, et al; U.S. Pat. No. 4,972,118, issued Nov. 20, 1990, to T. Yorifugi, et al; and U.S. Pat. No. 5,204,584, issued Apr. 20, 1993, to T. Ikeda.

There is, then, a need for a starting flag for use in a mercury discharge lamp, which starting flag is devoid of migration tendencies, does not oxidize during lamp sealing, does not evaporate under high operating temperature, and does not require oxidation of lead wires.

SUMMARY OF THE INVENTION

An object of the invention, is therefore, to provide a starting flag for use in a mercury discharge lamp, which starting flag includes a coating which does not migrate to the lead wire or glass, does not oxidize, does not evaporate under high temperature operating conditions, and does not require that the lead wire be oxidized.

With the above and other objects in view, as will hereinafter appear, a feature of the present invention is the provision of a starting flag for use in a low-pressure mercury discharge lamp. The starting flag comprises a metal foil and a layer of bonded molecular sieve particles adhered to the metal foil.

In accordance with a further feature of the invention, there is provided a low-pressure mercury discharge lamp comprising a sealed envelope defining a discharge space, and a thermally emitting electrode disposed at one end of the envelope. An inert gas and a quantity of mercury is sealed in the discharge space and a starting flag is disposed in the discharge space. The starting flag comprises a layer of bonded molecular sieve particles adhered to a metal foil.

The above and other features of the invention, including various novel details of construction and combinations of parts, will now be more particularly described with reference to the accompanying drawings and pointed out in the claims. It will be understood that the particular device embodying the invention is shown by way of illustration only and not as a limitation of the invention. The principles and features of this invention may be employed in various and numerous embodiments without departing from the scope of the invention.

BRIEF DESCRIPTION OF THE DRAWINGS

Reference is made to the accompanying drawings in which is shown an illustrative embodiment of the invention, from which its novel features and advantages will be apparent.

In the drawings.

DESCRIPTION OF THE PREFERRED EMBODIMENTS

Figure 2:
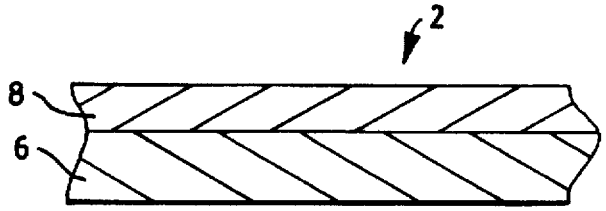
FIG. 2 PRIOR ART
FIG. 2 is an enlarged diagrammatic sectional view of an amalgam coated starting flag of FIG. 1.
Figure 3:
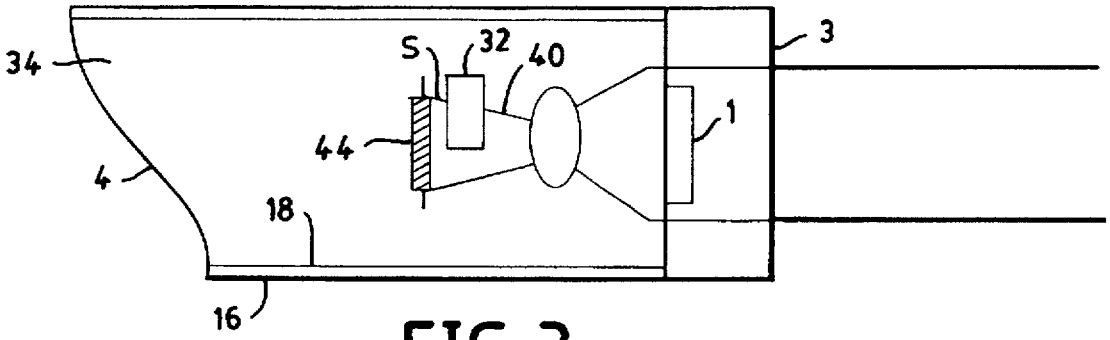
FIG. 3 is similar to FIG. 1, but shows one form of lamp illustrative of an embodiment of the invention.
Figure 4:
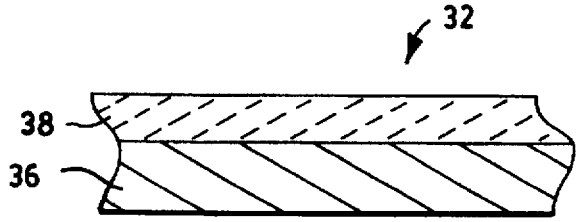
FIG. 4 is similar to FIG. 2, but shows one form of starting flag illustrative of an embodiment of the invention.

Referring to FIGS. 3 and 4, it will be seen that the illustrative starting flag 32 is similar to the starting flag 2 shown in FIG. 2, except in place of the layer 8 of indium metal, shown in FIG. 2, there is provided a layer 38 of bonded molecular sieve particles. By way of example, a suitable molecular sieve has been found in MOLSIV ADSORBENT 5A powder, available from UOP Corporation, 25 E. Algonquin Road, Des Plaines, Ill., 60017. The molecular sieve particles may be mixed with a sufficient quantity of an inorganic binder, such as a colloidal alumina sol, to form an adherent paint-like film when applied to the steel foil 36 of the starting flag 32. It has been found that an appropriate colloidal alumina sol is HYACOL AL-20, available from PQ Corporation, Ashland, Mass. 01721. The metal foil 36, which preferably is expanded stainless steel, preferably is pre-oxidized by heating in air so as to remove any oil film and to promote better adhesion of the layer 38 of molecular sieve particles.

Figure 1:
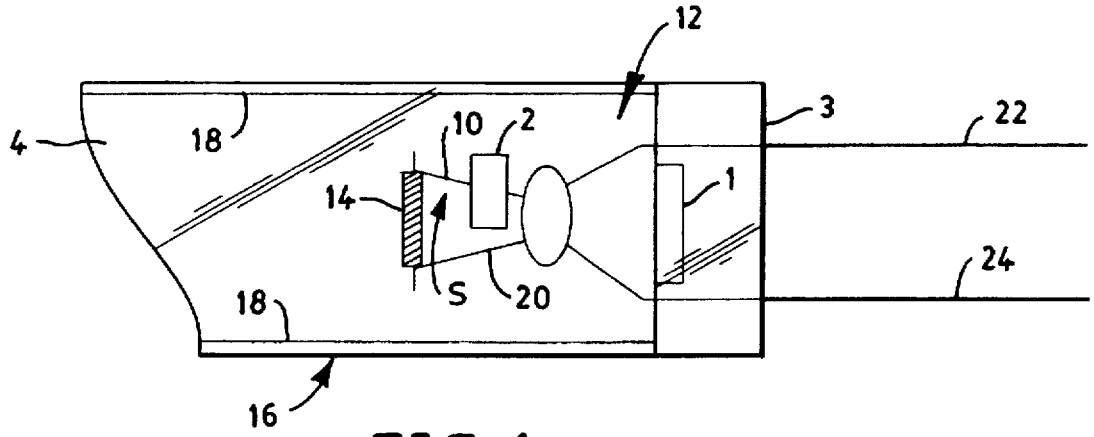
FIG. 1 PRIOR ART
FIG. 1 is a diagrammatic side elevational view of a portion of a low-pressure mercury discharge lamp illustrative of a prior art arrangement of amalgams.

As may be seen-in FIG. 3, the lamp structure of the improved lamp 34 utilizing the above described starting flag 32 is similar to that shown in FIG. 1. Differences are that the lead wire 40 on which the amalgam 32 is mounted is a standard unoxidized lead wire, and the starting flag 32 may beneficially be disposed a relatively smaller distance from the coil 44 than in the case with the standard starting flag 2 (FIG. 1), permitting higher flag operating temperatures, and therefore, more prompt release of mercury.

As used herein, the term "molecular seive" refers to dehydrated crystalline zeolites having the ability to selectively separate molecules on the basis of critical diameter. A zeolite is a group of molecules characterized by the presence of structural SiO, and $Al_3O_4$ groups, cation(s) to balance the negative charge of the aluminosilicate structure, and water of hydration. They may be crystalline or amorphous. The former types are of particular interest as the molecular sieves referred to herein. The cation(s) commonly found are sodium and calcium with barium, potassium, magnesium, strontium, and iron also possible. The natural zeolites are about 40 in number, the more familiar being chabazite, gmelinite, levynite, faujasite, analcime, and mordenite. The molecular sieves designated as "Type 5A" have what is termed the "A" crystal structure which is cubic, characterized by a three-dimensional network which has cavities 11.4 A in diameter separated by circular openings 4.2 A in diameter. This latter figure is the so-called pore diameter. The removal of water of crystallization leaves an "active" crystalline zeolite that has a void volume of 45 vol %. Adsorption of mercury in the instant starting flag coating occurs in these intracrystalline voids.

These zeolites, as a class, are characterized by the ability to adsorb molecules that have critical dimensions less than the effective pore size of the zeolite. The adsorbed chemical may be released by heating.

There is thus provided a starting flag having a coating which does not migrate to the lead wire on which it is mounted. The sieve material remains securely adhered to the stainless steel. There is further provided a coating in which oxidation thereof during lamp sealing does not occur, in which the evaporation of amalgam components in high temperature operation does not occur, and which does not require oxidation of the lead wires.

It is to be understood that the present invention is by no means limited to the particular construction herein disclosed and/or shown in the drawings, but also comprises any modifications or equivalents within the scope of the claims.

Having thus described our invention, what we claim as new and desire to secure by Letters Patent of the United States is:

What is claimed is:

1. A low-pressure mercury discharge lamp comprising:

a sealed envelope defining a discharge space;

a thermally emitting electrode disposed at one end of said envelope;

mercury vapor sealed in said discharge space; and a mercury releasing starting flag disposed in said discharge space and comprising an oxide layer of bonded molecular sieve particles adhered to a metal foil.

2. The lamp in accordance with claim 1 wherein said layer further comprises an inorganic binder mixed with said molecular sieve particles.

3. The lamp in accordance with claim 2 wherein said inorganic binder is colloidal alumina sol in sufficient quantity to cause said binder and said sieve particles to form a paint-like film on said metal foil.

4. The lamp in accordance with claim 1 wherein said metal foil is of stainless steel.

5. The lamp in accordance with claim 4 wherein said stainless steel foil is oxidized.

6. The lamp in accordance with claim 1 wherein said starting flag is disposed on a lead wire of said electrode.

7. The lamp in accordance with claim 1 wherein said electrode comprises a coil fixed at first and second opposite ends thereof, respectively, to first and second lead wires, and said starting flag is disposed on one of said lead wires of said electrode, adjacent said coil.

8. The lamp in accordance with claim 4 wherein said foil is of expanded stainless steel.

9. The lamp in accordance with claim 6 wherein said lead wire is unoxidized.

10. The lamp in accordance with claim 6 wherein said starting flag comprises an auxiliary starter comprising molecular sieve particles and said lamp further comprises a main amalgam disposed in said discharge space.

11. The lamp in accordance with claim 1 wherein said molecular sieve particles are of crystalline zeolite having a pore diameter sufficient to permit adsorption of mercury molecules and, upon heating, to release the adsorbed mercury molecules.

* * * * *